US006198445B1

(12) United States Patent
Alt et al.

(10) Patent No.: US 6,198,445 B1
(45) Date of Patent: Mar. 6, 2001

(54) CONFORMAL LOAD BEARING ANTENNA STRUCTURE

(75) Inventors: Kevin Herman Alt, Huntington Beach; Michael David Durham, Ventura; Allen John Lockyer, Huntington Beach; Daniel Patrick Coughlin, Torrance; James Kenneth Gath, Seal Beach; Jayanth Nandalke Kudva, Rancho Palos Verdes, all of CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/474,213

(22) Filed: Dec. 29, 1999

(51) Int. Cl.[7] ..... H01Q 1/28
(52) U.S. Cl. ..... 343/705; 343/872; 343/895
(58) Field of Search ..... 343/705, 708, 343/872, 700 MS, 873, 895; H01Q 1/28

(56) References Cited

U.S. PATENT DOCUMENTS

| | | | |
|---|---|---|---|
| 2,279,130 | 4/1942 | Bruce . | |
| 2,589,664 | 3/1952 | Bowman . | |
| 2,612,606 | 8/1952 | Wehner . | |
| 2,614,219 | 10/1952 | Cary . | |
| 2,661,422 | 12/1953 | Johnson et al. . | |
| 2,700,104 | 1/1955 | Bowman . | |
| 2,701,307 | 2/1955 | Cary . | |
| 2,845,624 | 7/1958 | Burberry . | |
| 3,005,986 | 10/1961 | Reed . | |
| 3,086,204 | 4/1963 | Alford . | |
| 3,613,098 | 10/1971 | Blasko . | |
| 3,633,206 * | 1/1972 | McMillan | 343/754 |
| 3,725,941 | 4/1973 | Stang . | |
| 3,868,693 | 2/1975 | Young . | |
| 4,392,139 | 7/1983 | Aoyama et al. . | |
| 4,675,686 | 6/1987 | Finken . | |
| 5,039,992 | 8/1991 | Lenormand et al. . | |
| 5,175,559 | 12/1992 | Schrank et al. . | |
| 5,184,141 | 2/1993 | Connolly et al. . | |
| 5,323,170 * | 6/1994 | Lang | 343/872 |
| 5,405,107 | 4/1995 | Bruno . | |
| 6,012,675 * | 1/2000 | Cocatre-Zilgien | 244/16 |

FOREIGN PATENT DOCUMENTS

| | | |
|---|---|---|
| 704659 | 2/1954 | (GB) . |
| 804666 | 11/1958 | (GB) . |
| WO 91/20107 | 12/1991 | (WO) . |

* cited by examiner

*Primary Examiner*—Tho Phan
(74) *Attorney, Agent, or Firm*—Terry J. Anderson; Karl J. Boch, Jr.

(57) ABSTRACT

A conformal load bearing antenna structure for attachment to an aircraft having an outer skin. The conformal load bearing antenna structure comprises a top face sheet and an end fed radiating element disposed thereon. Disposed adjacent to the top face sheet is a dielectric and a structural core disposed adjacent to the dielectric. In the preferred embodiment, a bottom face sheet is disposed adjacent to the structural core and an absorber is disposed adjacent to the bottom face sheet. Accordingly, the top face sheet, the dielectric, the structural core, and the bottom face sheet are configured to provide structural strength to the aircraft when the antenna is attached to the outer skin thereof.

13 Claims, 1 Drawing Sheet

CONFORMAL LOAD BEARING ANTENNA STRUCTURE

This invention was made with Government support under contract F33615-93-C-3200 awarded by the United States Air Force. The Government has certain rights in this invention.

BACKGROUND OF THE INVENTION

The present invention generally relates to aircraft antennas and more particularly to an antenna component that is a structural member of the aircraft.

Modern aircraft have a need to provide radio communication over a variety of frequency ranges and communication modes. For example, radio communication may be in the VHF band using amplitude modulation (AM) and/or frequency modulation (FM) or in the UHF band. In order to communicate effectively, the aircraft must include multiple antennas dispersed on the aircraft. Typically, the aircraft will include antennas mounted behind the radio transparent skin of the aircraft, and/or include exterior blade antennas mounted to the skin of the aircraft.

For effective communication, the antenna dimensions should be in the same order of magnitude as the wavelength of the signal being propagated. In this respect, the wavelength for operation in the VHF/AM and UHF band (i.e., 0.150 to 2.0 GHz) is approximately 0.1 to 2 meters. Accordingly, for effective communication within this range, the antenna must have a size correspondingly large. However, this is not practical because an antenna of this size would be aerodynamically inefficient. Therefore, small blade antennas electrically matched through impedance tuning networks are used. The blade antenna is a small fin protruding from the skin of the aircraft that is used as the radiating element.

Blade antennas are aerodynamically inefficient because they protrude from the skin of the aircraft. Typically, multiple blade antennas are used on the aircraft for the multiple communications band (i.e., UHF, VHF/FM, VHF/AM). The blade antenna exhibits poor performance characteristics at lower frequencies (i.e., 30–88 MHz). The blade antenna is constructed to withstand the forces subjected to the antenna, however the blade antenna is still susceptible to impact damage (i.e., break off). The blade antenna does not add any structural strength to the aircraft, and interferes with the aerodynamic efficiency of the aircraft.

In the prior art, antenna radiating elements have been embedded within the skin of the aircraft. Such radiating elements provide an antenna structure for the aircraft that is structurally integrated within the skin thereof. However, these prior art antenna structures are typically difficult to manufacture and install. Additionally, the prior art antenna structures do not exhibit ideal gain characteristics and fatigue life of these prior art antenna structures is significantly reduced due to the configuration of the antenna radiating element.

Specifically, the prior art antenna structures consisted of a spiral center fed radiating element embedded within the structure of the aircraft. The spiral center fed radiating element was difficult to install and did not exhibit desired gain and/or power characteristics. Furthermore, the antenna structure with the spiral center fed radiating element is not adaptable for existing aircraft. In this respect, the prior art antenna structure would need to be integrated into the original design of the aircraft.

The present invention addresses the above-mentioned deficiencies in prior aircraft antenna design by providing an antenna that is a structural member of the aircraft. In this respect, the aircraft antenna of the present invention is a structural member of the aircraft that can be adapted for multiple uses. The antenna structure of the present invention provides improved gain, higher power, improved fatigue life, and lower signature over the prior art spiral center fed antenna structure by using an end fed radiating element. Accordingly, the antenna structure of the present invention provides an improvement over the prior art inasmuch as the antenna exhibits desired operating characteristics.

BRIEF SUMMARY OF THE INVENTION

A conformal load bearing antenna structure for attachment to an aircraft having an outer skin. The conformal load bearing antenna structure comprises a top face sheet and an end fed radiating element disposed thereon. Disposed adjacent to the top face sheet is a dielectric and a structural core disposed adjacent to the dielectric. In the preferred embodiment, a bottom face sheet is disposed adjacent to the structural core and an absorber is disposed adjacent to the structural core. An absorber pan is disposed adjacent to the absorber. Accordingly, the top face sheet, the dielectric, the structural core, and the bottom face sheet are configured to provide structural strength to the aircraft when the antenna is attached to the outer skin thereof.

In the preferred embodiment, the antenna structure further comprises a transmission mechanism disposed adjacent to the absorber and in electrical communication with the radiating element. The transmission mechanism comprises a center feed and at least one transmission strip radiating outwardly therefrom. Each of the transmission strips comprises an inner portion connected to the center feed and an outer portion having a contact. Each of the contacts is in electrical communication with the radiating element. In the preferred embodiment, the radiating element comprises four spirals, each of which are in electrical communication with respective ones of the contacts.

Typically, the top face sheet, the dielectric, the structural core, and the bottom face sheet are all bonded together with an appropriate adhesive. It will be recognized, that the top face sheet may be fabricated from a fiberglass material and the dielectric is fabricated from an epoxy loaded with titanium dioxide. The structural core of the antenna structure is fabricated from a honeycomb material, while the bottom face sheet is fabricated from fiberglass. The absorber is fabricated from a graphite loaded honeycomb material in order to provide the necessary dielectric characteristics. The antenna structure additionally can include an absorber pan. The absorber pan encloses the absorber and is fabricated from a graphite material.

In accordance with the present invention, there is provided a method of forming a conformal load bearing antenna structure for an aircraft from a top face sheet, an end fed radiating element, a dielectric, a structural core, a bottom face sheet, an absorber and an absorber pan. The method comprises bonding the end fed radiating element to the top face sheet and then bonding the top face sheet to the dielectric. Next, the structural core is bonded to the dielectric and the bottom face sheet is bonded to the structural core. Finally the absorber is bonded to the bottom face sheet in order to form the load bearing antenna structure. It will be recognized that the antenna structure may further comprise an absorber pan that is bonded to the absorber and the bottom face sheet. It will be recognized that the antenna structure may further comprise a transmission mechanism that is positioned in electrical communication with the radiating element. In this respect, the transmission mechanism is positioned beneath the absorber and has contacts which are placed through respective apertures of the absorber, bottom face sheet, structural core, and dielectric. Therefore, RF signals may be sent and received by the radiating element via the transmission mechanism and respective contacts.

BRIEF DESCRIPTION OF THE SEVERAL VIEWS OF THE DRAWING

These as well as other features of present invention will become more apparent upon reference to the drawings wherein.

DETAILED DESCRIPTION OF THE INVENTION

Figure 1:
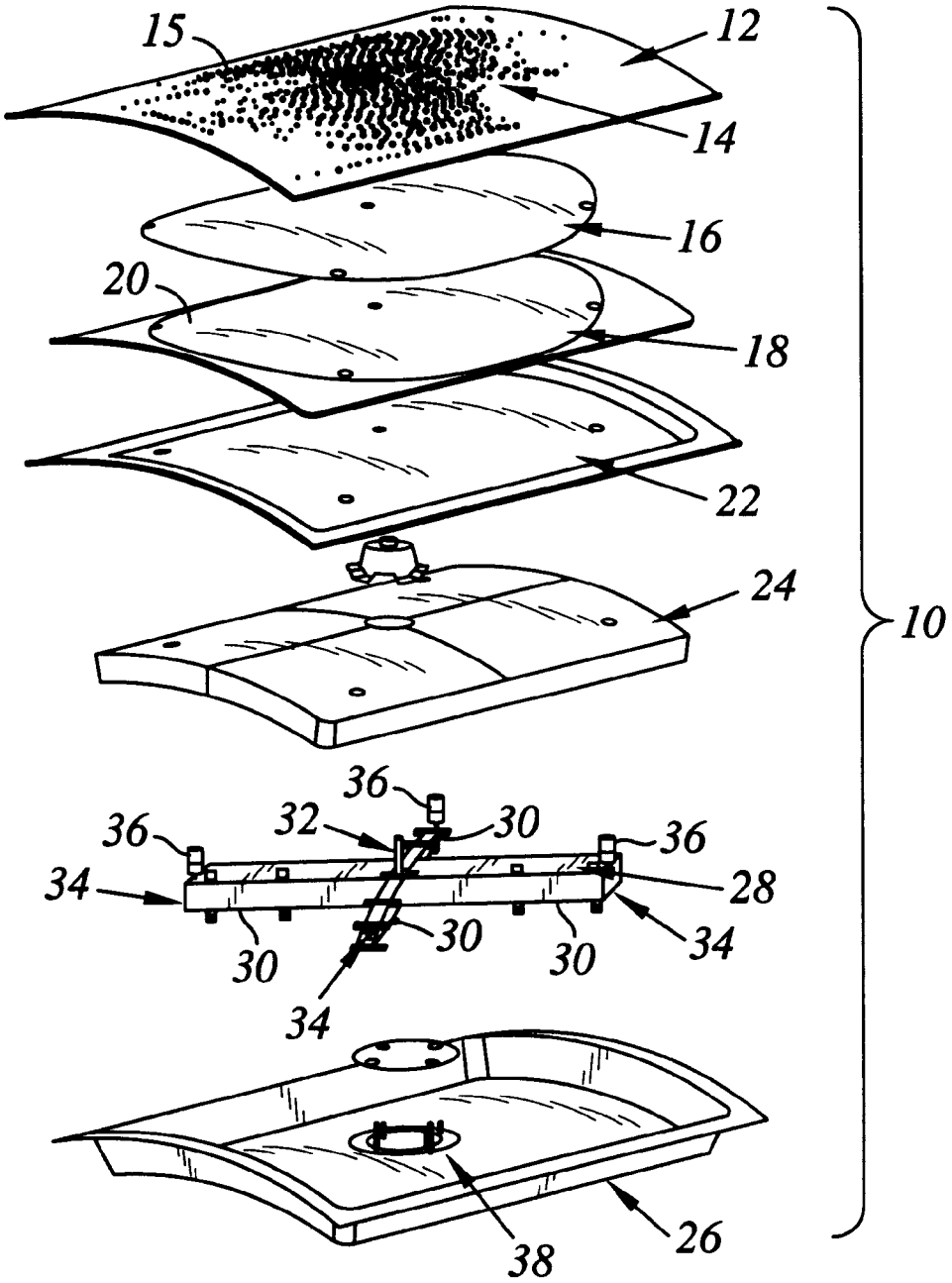
FIG. 1 is an exploded, perspective view of the antenna structure constructed in accordance with the preferred embodiment of the present invention.

Referring now to the drawings wherein the showings are for purposes of illustrating the preferred embodiment of the present invention only, and not for purposes of limiting the same, FIG. 1 illustrates a conformal load bearing antenna structure 10 constructed in accordance with the present invention. The antenna structure 10 has a sandwich construction that provides structural rigidity against buckling without using additional stiffeners. The sandwich core also provides a cavity that is required for antenna performance. The sandwich construction consists of several basic layers. Each layer must meet different combinations of structural and electrical design requirements, as well as manufacturing and assembly requirements. Additionally, the sandwich construction is very weight efficient and the core of the sandwich provides the space needed for the cavity-backed antenna to function properly. As will be recognized by those of ordinary skill in the art, the sandwich construction allows the antenna structure 10 to be integrated within the skin of an aircraft. By integrating the antenna structure 10 into the skin of the aircraft, it is possible to provide an antenna that is a structural member thereof.

Referring to FIG. 1, the antenna structure 10 comprises a top face sheet 12. The top face sheet 12 must carry a significant portion of the in-plane loads and contribute to the overall panel buckling resistance of the antenna structure 10. Furthermore, the top face sheet 12 provides low velocity impact and environmental resistance. The top face sheet 12 allows transmission and receiving of RF signals. Accordingly, the top face sheet 12 is fabricated from a material that must be a low dielectric and have low loss characteristics in order to minimize signal attenuation and reflection losses. As will be recognized, this is especially critical when the antenna beam is scanned or steered near the horizon or at nearly the same plane as the antenna structure 10. In the preferred embodiment, the top face sheet 12 is constructed from five plies of fiberglass material epoxied together and has an overall thickness of approximately 0.0624 inches. It will be recognized, that other materials may be used for the top face sheet 12 including, but not limited to, nonconductive glass, quartz fibers, or organic fibers.

Bonded to the inner surface of the top face sheet 12 is a radiating element 14. The radiating element 14 may be a single ply of a metalized polymeric material etched into four spiral patterns 15. For example, the radiating element may be grade 3 copper electro-deposited into a Kapton sheet and then etched into the four spiral patterns 15. Accordingly, the spiral antenna element patterns 15 are active radiating elements of the antenna structure 10 and transmit and receive RF signals. The radiating element 14 does not contribute to structural strength or rigidity of the antenna structure 10, but must survive the manufacturing process thereof. In the preferred embodiment, the multi-arm spiral patterns 15 have a four arm configuration. Accordingly, the four arm configuration allows for four different radiating elements to be bonded to the top face sheet 12. Each of the spiral patterns is in respective electrical communication with a transceiver of the aircraft, as will be further explained below. Each of the spiral patterns 15 has a connecting point at the outside of the pattern. In this respect, the receiver of the aircraft is in electrical communication with each of the patterns 15 at the outside circumference of the radiating element 14. Therefore, each of the spiral patterns 15 will have a connection disposed approximately 90° apart from an adjacent spiral pattern 15. By providing for connection to each spiral pattern 15 at the circumference thereof, the radiating element 14 exhibits improved gain and power characteristics. The radiating element 14, accordingly, can send and receive signals in the range from about 150 MHz to 2.0 GHz. This allows the antenna structure 10 to communicate within UHF satellite communication bandwidth.

As will be recognized, the end fed configuration of the radiating element 14 provides improved gain and power for the antenna structure 10. As previously mentioned, the prior art antenna structure comprised of a center fed radiating element. However, the end fed configuration of the radiating element 14, provides improved characteristics over the center-fed configuration. Therefore, it is advantageous to use the end fed configuration of the radiating element 14 for the antenna structure 10.

Referring to FIG. 1, the antenna structure 10 further includes a dielectric 16 disposed below the top face sheet 12 such that the dielectric 16 is disposed adjacent to the end fed radiating element 14. The dielectric 16 has a generally circular configuration and a diameter approximately equal to the diameter of the radiating element 14. Typically, the dielectric 16 is a high dielectric but low loss material. The dielectric 16 enables a reduction in the size of the antenna since the radiating element 14 is a traveling wave antenna. Accordingly, the dielectric 16 slows the traveling current waves of the radiating signal and allows the radiating element 14 to perform as if it were 3 to 4 times the unloaded equivalent size. This phenomenon is referred to as dielectric scaling or size reduction. Without the dielectric 16, an electrically equivalent antenna would be prohibitively large for the aircraft. The dielectric 16 is fabricated from epoxy resin loaded with titanium oxide ($TiO_2$). The total thickness of the dielectric 16 is approximately 0.120 inches and has a size of approximately 30 inches in diameter. The dielectric 16 is preferably bonded to the top face sheet 12. Accordingly, the dielectric 16 provides structural strength to the antenna structure 10. In this respect, the thermal expansion of the dielectric 16 and the top face sheet 12 must be compatible with the overall thermal expansion of the antenna structure 10.

The antenna structure 10 further includes a structural core 18 bonded to the top face sheet 12 and disposed adjacent to the dielectric 16. The structural core 18 is approximately the same dimension as the top face sheet 12. The core 18 is fabricated from a phenolic honeycomb material. Referring to FIG. 1, the core 18 includes a reduced thickness center section 20. In this respect, the reduced thickness center section 20 has a generally circular configuration with the same diameter as the dielectric 16 (i.e., about 30 inches).

The center section 20 is configured to receive the dielectric 16 therein such that the dielectric 16 is substantially flush with the structural core 18. Typically the core 18 has a total thickness of 0.6 inches and the center section 18 has a thickness of only about 0.48 inches. The core 18 transmits shear forces from the top face sheet 12 induced from bending loads in the overall antenna structure 10. Additionally the core 18 supports the top face sheet 12 against compression wrinkling and provides impact resistance, thereby increasing the overall buckling resistance of the antenna structure 10. In order for proper radiation of the radiating element 14, the core 18 must be capable of allowing transmission of RF signals radiated from the inner side of the radiating element 14. Accordingly, it will be recognized that the core 18 may be manufactured from non-conductive glass and/or other organic fibers.

Bonded to the structural core 18 is a bottom face sheet 22, as seen in FIG. 1. The bottom face sheet 22 carries in-plane loads and contributes to overall buckling resistance of the antenna structure 10. Further, the bottom face sheet 22 allows transmission of RF signals therethrough. In this respect, the bottom face sheet 22 is constructed from non-conductive glass, quartz, or other organic fiber reinforcements. In the preferred embodiment, the bottom face sheet 22 is woven fiberglass and epoxy, and has an approximate thickness of approximately 0.046 inches at the center section. As can be seen in FIG. 1, the edges of the bottom face sheet 22 are built up (i.e., multiple layers). Accordingly, the bottom face sheet 22 is bonded to the top face sheet 12 through the use of an appropriate non-conductive adhesive. The edges of the bottom face sheet 22 have an increased thickness of approximately 0.098 inches. In this respect, the edges provide additional structural support for bonding to the top face sheet 12. The added thickness of the bottom face sheet 22 balances introduction of in-plane loads from the top face sheet 12 into the bottom face sheet 22 without applying excessive loads on the structural core 18.

Disposed below and adhesively attached to the bottom face sheet 22 is an absorber 24. Referring to FIG. 1, the absorber 24 has an approximate size equal to the bottom face sheet 22. The absorber 24 is a non-structural layer that absorbs or attenuates the RF signal transmitted by the radiating element 14. As will be recognized to those of ordinary skill in the art, the radiating element 14 will radiate RF signals inwardly toward the absorber core 24. In order to eliminate interference with other equipment of the aircraft, the absorber 24 must absorb and/or eliminate such radiated RF signals. Accordingly, the absorber 24 must be fabricated from a material which absorbs signals from the entire frequency band of the radiating element 14. Advantageously, the thickness of the absorber 24 must be kept to a minimum so as to provide an antenna structure 10 with a minimum thickness as possible. In the preferred embodiment, the absorber 24 is fabricated from a graphite loaded phenolic honeycomb core material which provides the necessary absorption characteristics for the elimination of signals radiated from the radiating element 14.

As seen in FIG. 1, the absorber 24 is disposed above an absorber pan 26. In this respect, the absorber pan 26 provides an enclosure for the absorber 24. The absorber pan 26 includes a conductive mat and/or conductive path (not shown) in order to provide lighting protection and/or a ground plane for the radiating element 14. Typically, the absorber pan 26 is fabricated from graphite with epoxy resin. Alternatively, the absorber pan 26 may be fabricated from graphite twill cloth with a vinyl ester resin. Not only is the absorber pan 26 bonded to the absorber core 24, as previously mentioned, but the absorber pan 26 is additionally bonded to the bottom face sheet 22. However, the absorber pan 26 is not constructed to provide any structural strength and/or rigidity to the antenna structure 10.

Referring to FIG. 1, the antenna structure 10 further includes a transmission mechanism 28. The transmission mechanism 28 provides a pathway for the RF signal from the aircraft transceiver to the radiating element 14. Accordingly, as seen in FIG. 1, the transmission mechanism 28 comprises four transmission strips 30. The transmission strips 30 are configured in a generally x-shaped pattern. In this respect, the center of each transmission strip 30 is attached to one another to form a center feed 32. Each of the transmission strips 30 radiates outwardly from the center-feed 32 and terminates at a transmission point 34. Each of the transmission points 34 includes a contact 36. The contacts 36 are sized to extend through a respective aperture formed in the absorber 24, bottom face sheet 22, structural core 18, and dielectric 16. Accordingly, each contact 36 is in electrical communication with a respective spiral pattern 15 of the radiating element 14. As seen in FIG. 1, the absorber pan 26 includes a center aperture 38. The center aperture 38 is configured to allow the transmission of RF signals through the absorber pan 26 such that RF signals are received by the transmission mechanism 28. Once received from the transmission mechanism 28, the RF signals are transmitted to each transmission strip 30 via the center feed 32. Accordingly, the RF signals are then radiated outwardly to the transmission points 34 and through respective contacts 36. It will also be recognized that the radiating element 14 may receive RF signals from an outside source. In this respect, the radiating element 14 will transmit such RF signals through the contacts 36 and transmission strips 30 such that the received RF signal will be propagated to the center feed 32.

In the preferred embodiment of the present invention, the structural portion of the antenna structure 10 is fabricated from two halves. In this respect, the top half is a top face sheet subassembly comprising the top face sheet 12 and radiating element 14. The bottom half is a bottom face sheet subassembly comprising the bottom face sheet 22, the structural core 18 and the dielectric 16. The top half and the bottom half may be fabricated separately and then bonded together in order to form the completed antenna structure 10.

It will be recognized by those of ordinary skill in the art that the conformal load bearing antenna structure 10 may be used for applications other than aircraft. Accordingly, the antenna structure 10 has the capability to replace any antenna on various types of vehicles (e.g., automobiles, surface ships, etc . . .). The conformal load bearing antenna structure 10 can be modified such that any type of antenna may be embedded within the vehicle, not just an antenna for use in the UHF frequency band.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A conformal load-bearing antenna structure for attachment to an aircraft having an outer skin, the antenna comprising:

a top face sheet;

an end fed radiating element disposed adjacent to the top face sheet;

a dielectric disposed adjacent to the end fed radiating element;

a structural core disposed adjacent to the dielectric;

a bottom face sheet disposed adjacent to the structural core;

an absorber disposed adjacent to the bottom face sheet; and an absorber pan disposed adjacent to the absorber;

wherein the top face sheet, the dielectric, the structural core, and the bottom face sheet are configured to provide structural strength to the aircraft when the antenna is attached to the outer skin of the aircraft.

2. The antenna structure of claim 1 further comprising a transmission mechanism disposed adjacent to the absorber and in electrical communication with the radiating element.

3. The antenna structure of claim 2 wherein the transmission mechanism comprises a center feed and at least one transmission strip radiating outwardly from the center feed.

4. The antenna structure of claim 3 wherein each of the transmission strips comprises an inner portion connected to the center feed and an outer portion having a contact.

5. The antenna structure of claim 4 wherein each of the contacts is in electrical communication with the radiating element.

6. The antenna structure of claim 5 wherein the radiating element comprises four spirals, each of the spirals in electrical communication with a respective one of the contacts.

7. The antenna structure of claim 1 wherein the top face sheet, the dielectric, the structural core, and the bottom face sheet are bonded together.

8. The antenna structure of claim 1 wherein:

the top face sheet is fabricated from fiberglass;

the dielectric is fabricated from epoxy loaded with titanium dioxide;

the structural core is fabricated from a honeycomb material;

the bottom face sheet is fabricated from fiberglass; and the absorber is fabricated from a loaded honeycomb material.

9. The antenna structure of claim 8 wherein the absorber pan is fabricated from a graphite material.

10. A method of forming a conformal load-bearing antenna structure for an aircraft from a top face sheet, an end feed radiating element, a dielectric, a structural core, a bottom face sheets, an absorber, and an absorber pan, the method comprising the steps of:

a) bonding the end fed radiating element to the top face sheet;

b) bonding the top face sheet having the radiating element to the dielectric;

c) bonding the structural core to the dielectric;

d) bonding the structural core to the bottom face sheet to form the load bearing antenna structure; and e) bonding the absorber to the bottom face sheet and bonding the absorber pan to the absorber and the bottom face sheet.

11. The method of claim 10, further comprising the step of:

f) attaching the conformal load-bearing antenna structure to the aircraft such that the antenna structure becomes a structural component of the aircraft.

12. The method of claim 11, wherein step (f) comprises attaching the antenna structure to the skin of the aircraft.

13. The method of claim 10, wherein step (b) comprises bonding the top face sheet to the dielectric such that the radiating element is disposed between the top face sheet and the dielectric.

* * * * *